United States Patent [19]

Jakob

[11] Patent Number: 4,681,473

[45] Date of Patent: Jul. 21, 1987

[54] LOOSE-LEAF BINDER FOR STACKS OF SHEETS

[76] Inventor: Lothar Jakob, Holteigasse 8, A-1210 Vienna, Austria

[21] Appl. No.: 845,467

[22] Filed: Mar. 28, 1986

[30] Foreign Application Priority Data

Apr. 5, 1985 [AT] Austria ..... 1047/85

[51] Int. Cl.[4] ..... B42F 13/04

[52] U.S. Cl. ..... 402/15; 24/129 R; 402/13; 402/48

[58] Field of Search ..... 24/129 R, 129 B, 130; 402/8, 9, 12, 13, 14, 15, 16, 17, 18, 48

[56] References Cited

U.S. PATENT DOCUMENTS

| | | | |
|---|---|---|---|
| 484,268 | 10/1892 | Westrup | 402/13 X |
| 708,102 | 9/1902 | Waldo Jr. | 402/48 |
| 828,765 | 8/1909 | Nilsson . | |
| 1,008,810 | 11/1911 | Freese | 402/13 |
| 1,205,496 | 11/1916 | Whitehead . | |
| 1,366,212 | 1/1921 | Pollard . | |
| 1,383,665 | 7/1921 | Rohan . | |
| 1,426,537 | 8/1922 | Bauer . | |
| 1,690,230 | 11/1928 | Kline | 402/15 |

FOREIGN PATENT DOCUMENTS

| | | | |
|---|---|---|---|
| 1093777 | 12/1960 | Fed. Rep. of Germany | 402/15 |
| 556449 | 7/1923 | France | 402/14 |
| 273968 | 6/1951 | Switzerland | 402/9 |
| 17618 | of 1895 | United Kingdom . | |
| 20988 | of 1905 | United Kingdom | 402/13 |
| 2022 | of 1909 | United Kingdom . | |
| 124938 | 4/1919 | United Kingdom | 402/13 |
| 290332 | 5/1928 | United Kingdom . | |
| 733889 | 7/1955 | United Kingdom . | |

*Primary Examiner*—Paul A. Bell

*Attorney, Agent, or Firm*—Nixon & Vanderhye

[57] ABSTRACT

The invention refers to a loose-leaf binder for a stack of paper sheets, comprising a cord or twine adapted to be passed through a perforation in a stack of sheets and comprising a clamping means for the cord or twine formed by a plate member having a first slot extending from the edge of the plate member in an approximately perpendicular direction relative to said edge to approximately the center of the plate member and adapted to receive the cord or twine, and a second slot extending from the edge of the plate member located opposite the mouth of the first slot at an acute angle relative to a tangent line to said edge at that location to form an acute-angled portion delimited by the second slot and the edge of the plate member, the acute-angled portion obliquely upwardly bent to one side of the surface of the plate member.

8 Claims, 5 Drawing Figures

FIG. 1
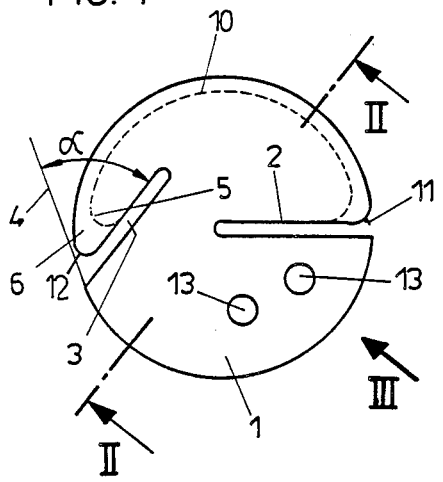
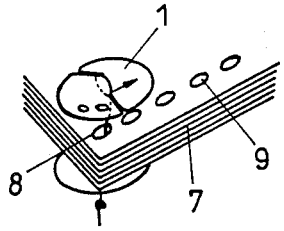
FIG. 4
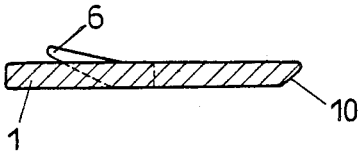
FIG. 2
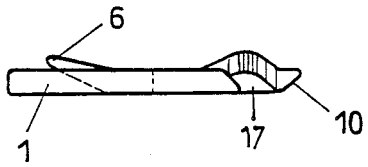
FIG. 3
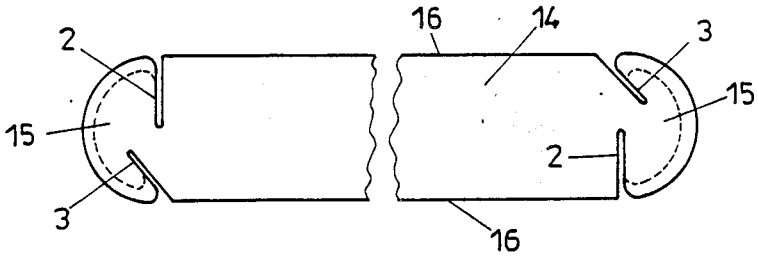
FIG. 5

LOOSE-LEAF BINDER FOR STACKS OF SHEETS

BACKGROUND OF THE INVENTION

Field of the Invention and Description of the Prior Art

The invention refers to a loose-leaf binder for a stack of sheets, comprising an elongated connecting element, in particular a cord or, respectively, twine, adapted to be passed through a perforation of the stack of sheets and comprising clamping means for the connecting element.

SUMMARY OF THE INVENTION

It is an object of the invention to provide an inexpensive loose-leaf binder which can easily be manipulated. The invention essentially consists in that the clamping means is formed of a preferably circular plate member having a first slot extending from the edge of the plate member in an approximately normal direction relative to said edge to approximately the center of the plate member and serving the purpose of passing therethrough the connecting element, and having a second slot extending from the edge of the plate member at a location located opposite the mouth of said first slot at an acute angle relative to the edge of said plate member or, respectively, relative to the tangent line to said edge at said location, in that the acute-angled portion, being delimited by the second slot and the edge of the plate member, is obliquely upwardly bent in direction to one side of the surface of the plate member edge of the plate member is chamferred along its surface from said second slot to said first slot via the acute-angled portion of said plate member. On binding of stacks of sheets, the elongated connecting element, for example cord or twine, is passed through the holes of the stack of sheets. The clamping means is placed on top of the stack of sheets and the cord or twine is pushed into the first slot. On account of said slot extending approximately to the center of the plate member, the cord thus arrives at the center of the plate member. Subsequently, the cord is shifted into the second slot. On account of said second slot extending at an acute angle relative to the edge of the plate member or relative to a tangent line at this edge, respectively, said cord extends through said slot till the bottom side of said plate member and can be pulled at the bottom side of the plate member between the plate member and the stack of sheets in a direction opposite to the acute angle and can subsequently again be shifted into said first slot. In this manner, the cord is already reliably clamped within the clamping means and the stack of sheets is held together. The clamping means is placed onto the topside of the stack of sheets such that the acute-angled portion of the plate member, which is delimited by the second slot and the edge of the plate member, faces upwardly. It is thus easily possible to introduce the cord or twine into the second slot by simply winding the cord or twine around the clamping means. On account of the edge of the plate member being chamferred at the side located opposite the upward bend from the second slot to the first slot via the acute-angled portion of the plate member, it becomes easily possible to pull the cord between the stack of sheets and the surface of the plate member resting on the stack of sheets and to pass said cord till the first slot and thus to finally fix in position said cord. Loosening of the tightened clamping means is then easily possible by winding the cord or the twine around the clamping means in the opposite sense, whereby the cord or twine is moved out of the second slot. The cord or twine can then also be put out of the first slot, in which case the loose-leaf binder is completely loosened. When binding a stack of sheets, in particular when binding a stack of continuous forms being folded according an accordion or concertina type fold, the stack is frequently partially covered by the clamping means. The cord or twine can then simply be left within the first slot for loosening the clamping device to such an extent that it can be lifted off the stack of sheets and the writing becomes legible. In this case, the elongated connecting element has the advantage of being loosenable to such an extent that the sheets can be turned over without the danger of coming out of order because the sheets are maintained in their correct sequence by the elongated connecting element such as cord or twine. The invention thus provides substantial advantages when binding, loosening or turning over the sheets of the stack of sheets or of the continuous form. If it is intended to turn over the sheets, the cord or twine can simply be clamped in the clamping means in a loosened position. According to the invention, the second slot delimiting the acute-angled portion of the plate member is inclined at approximately 60° relative to a tangent line applied to the edge of the plate member at the location of the mouth of the slot. Such an inclination of the second slot facilitates introduction by pulling action of the cord into the slot and between plate member and stack of sheets. According to the invention, also that portion of the plate member, which is located between the first slot and the chamferred edge of the plate member, can be bent upwardly in direction to the same side as is upwardly bent the acute-angled portion of the plate member, so that there is also facilitated the very first introduction of the cord into the first slot. According to the invention, the width of the slot is slightly smaller than the thickness of the connecting element such as cord. In this manner, the cord is better clamped within the slots. Conveniently and according to the invention, the slots are outwardly tapered at the respective mouth which facilitates introduction of the cord or the like into the slots even when their width is smaller than the thickness of the cord.

For binding a stack of sheets, there are most frequently required two cords extending through perforations of the stack of sheets and two clamping means. However, the clamping means can, according to the invention, be formed in an advantageous manner of an elongated bar having arranged at its ends, which are preferably rounded along circular lines, the first and the second slot departing from the longitudinal sides of the bar. In this case, one bar carrying at each of its ends one clamping means is sufficient and the design of this clamping means as a bar is advantageous for achieving a stable binding effect. On account of the slots starting from the longitudinal sides of the bar, the cord can be placed into the clamping means in the same manner as in a clamping means having the shape of a circular plate member. In this case it is of advantage if the ends of the bar are symmetric relative to an axis of symmetry extending in normale direction to the surface of the bar at its center, because, on the one hand, the same tool can be used for forming both ends of the bar and because, above all, the cord can be placed into the second slot of both clamping means provided at the ends of the bar in the same sense and the cords can be pulled at both ends of the bar into the gap between the bar and the stack of sheets.

If the clamping means is formed of a circular plate member, the plate member can, according to the invention, have at least one hole of greater diameter than is the width of the slot at that side of the plate member, which is located opposite the acute-angled portion of the plate member delimited by the second slot. This provides a further possibility of utilizing the clamping means which can be now used as a locking means for a lacing, for example for parcels or stacks of sheets. The cord is pulled through the hole and fixed on the plate member, whereupon the other end of the cord is placed within the first slot in an analogous manner and then clamped by being placed into the second slot and again being placed into the first slot.

The clamping means according to the invention is of particular advantage for binding stacks of sheets, in particular stacks of continuous forms of accordion type folding. The clamping means can, however, also be used in an other manner and can, for example, also serve as a belt buckle.

BRIEF DESCRIPTION OF THE DRAWING

In the drawing, the invention is explained with reference to embodiments shown in the drawing in which FIG. 1 shows in a top plan view a clamping means comprising a circular plate member, FIG. 2 shows a section along line II—II of FIG. 1, FIG. 3 shows a view in direction of the arrow III, FIG. 4 shows a clamping means as applied to a stack of sheets and FIG. 5 shows a clamping means formed of a bar.

DETAILED DESCRIPTION OF THE PREFERRED EMBODIMENTS

In the embodiment according to FIGS. 1 to 3, the clamping means is formed of a circular plate member 1. This plate member has a slot 2 departing from the edge of the plate member. At the opposite side of the plate member, there is provided a second slot 3 which extends at an acute angle $\alpha$ relative to a tangent line 4 applied to the edge of the plate member 1 at the location of the mouth of the second slot. This angle $\alpha$ is approximately 60°. An acute-angled portion 5 of the plate member is delimited by this second slot, said portion 5 being upwardly bent at its tip 6 to one side of the plate member.

The plate member 1 is, as is shown in FIG. 4, placed onto the stack 7 of sheets. A cord 8 (also called twine) is pulled through a hole of the perforation 9 of the stack of sheets and is placed into the first slot 2 and is shifted till the end of the slot, the cord extending approximately centrally through the plate member 1 in the position now assumed. Subsequently, the cord is placed into the second slot 3 from top, which is facilitated on account of the tip 6 of the acute-angled portion 5 of the plate member being bent in an upward direction. Thereupon, the cord is pulled into the gap between the plate member 1 and the stack 7 of sheets, which is facilitated on account of a chamfer 10 being provided on the bottom side of the plate member. Subsequently, the cord 8 can again be pulled into the first slot 2 from the bottom side. The width of the slots is somewhat smaller than the thickness of the cord 8, so that the cord can already be clamped when being introduced into the second slot. Subsequently, the cord can, if desired, again be pulled into the second slot 3 and again be pulled into the gap between the plate member 1 and the stack 7 of sheets at the location of the chamfer 10.

As is shown in FIG. 1, the slots 2 and 3 are enlarged at their area of transition into the circumference of the plate member 1 as is indicated by reference numerals 11 and 12. As is shown in FIG. 3, a groove 17 accommodating the cord can be provided at the margin of the plate member 1 at the bottom side thereof.

As is shown in FIG. 1, the plate member 1 has two holes 13 of greater diameter than is the width of the slots 2 and 3, said holes being provided at that side of the plate member which is opposite the acute-angled portion 5 of the plate member. These holes 13 provide the possibility to pass therethrough one end of the cord and to fix this end. The other end is then introduced into the slots 2 and 3 in the manner described above. In this manner, the clamping means 1 can also be used for providing a lacing.

FIG. 5 shows the design of the clamping means as a bar 14. The ends 15 of this bar are rounded and form two clamping means as described in connection with FIGS. 1 to 3. On account of the slots 2 and 3 departing from the longitudinal side 16 of the bar 14, clamping of the cord can be effected in the same manner as by means of the clamping plates according to FIGS. 1, 2 and 3.

What is claimed is:

1. Binding means for a stack of sheets, comprising an elongated connecting element adapted to be passed through the perforations of a stack of perforated sheets, and further comprising a clamping means for the connecting element formed of a generally circular plate member having a first slot extending from a mouth at the edge of the plate member in an approximately normal direction relative to said edge to approximately the center of the plate member and adapted to receive the connecting element therethrough, said plate member having a second slot extending from a mouth at the edge of the plate member at a location opposite the mouth of said first slot at an acute angle ($\alpha$) relative to a tangent line to said edge at said location, to form an acute-angled portion delimited by the second slot and the edge of the plate member , said acute-angled portion being obliquely upwardly bent with respect to one side of the surface of the plate member, and wherein the edge of the plate member is chamferred from said second slot to said first slot along the acute-angled portion of said plate member.

2. Binding means as claimed in claim 1, characterized in that the second slot is inclined approximately 60° relative to the tangent line (4) applied to the edge of the plate member at the location of the mouth of the second slot.

3. Binding means as claimed in claim 1 characterized in that that portion of the plate member, which is located between the first slot and the chamferred edge of the plate member, is upwardly bent in the same direction as the acute-angled portion of the plate member.

4. Binding means as claimed in claim 1, characterized in that the width of the slots is slightly smaller than the thickness of the connecting element.

5. Binding means as claimed in claim 1 characterized in that the slots are enlarged at their respective mouths.

6. Binding means as claimed in claim 1 characterized in that the plate member has at least one hole of greater diameter than is the width of the slots, said at least one hole being provided at that side of the plate member which is located opposite the acute-angled portion, of the plate member, delimited by the second slot.

7. Binding means for a stack of sheets, comprising an elongated connecting element adapted to be passed through the perforations of a stack of perforated sheets and further comprising clamping means for the connecting element, wherein the clamping means is formed of an elongated barlike plate member having opposed side edges and having opposed, generally semi-circular end portions each end portion further comprising: a first slot extending from a mouth at one side edge of the elongated plate member in an approximately normal direction relative to said side edge to approximately half way through said elongated plate member, said first slot being adapted to receive the connecting element; a second slot extending from a mouth at the opposed side edge of the elongated plate member at a location opposite the mouth of said first slot, said second slot extending at an acute angle ($\alpha$) relative to a tangent line to said opposed side edge at said location to form an acute-angled portion delimited by the second slot and the semi-circular edge of the end portion, said acute-angled portion being obliquely upwardly bent to one side of the surface of the elongated plate member; and the edge of said semi-circular end portion being chamferred from said second slot to said first slot along said acute-angled portion of said plate member.

8. A loose-leaf binder as claimed in claim 1, wherein said elongated element comprises cord or twine.

* * * * *